United States Patent [19]

DuRocher et al.

[11] 4,067,102

[45] Jan. 10, 1978

[54] METHODS OF MANUFACTURING TACTILE SWITCH FOR KEYBOARDS AND THE LIKE

[75] Inventors: Gideon A. DuRocher; Daniel J. DuRocher, both of Mt. Clemens, Mich.

[73] Assignee: Essex International, Inc., Ft. Wayne, Ind.

[21] Appl. No.: 558,481

[22] Filed: Mar. 14, 1975

Related U.S. Application Data

[63] Continuation-in-part of Ser. No. 411,345, Oct. 31, 1973, Pat. No. 3,876,586.

[51] Int. Cl.[2] ..... H01H 11/00; H01H 11/06

[52] U.S. Cl. ..... 29/622; 264/27; 264/104; 264/250

[58] Field of Search ..... 29/622; 264/27, 104, 264/250, 251, 267; 200/5 A, 83 N, 86 R, 86 A, 159 R, 159 B, 262, 264, 267

[56] References Cited

U.S. PATENT DOCUMENTS

| | | | |
|---|---|---|---|
| Re. 15,653 | 7/1923 | Allcutt | 264/250 |
| 1,099,071 | 6/1914 | McCoy, Jr. | 264/27 |
| 2,040,919 | 5/1936 | Caldwell | 200/159 B |
| 2,509,652 | 5/1950 | Rushmer et al. | 264/27 |
| 2,886,854 | 5/1959 | Franklin | 264/104 |
| 3,233,059 | 2/1966 | Pridham, Jr. et al. | 200/83 N |
| 3,723,684 | 3/1973 | Greenwood | 200/83 N |
| 3,860,771 | 1/1975 | Lynn et al. | 200/262 |

*Primary Examiner*—C.W. Lanham
*Assistant Examiner*—Daniel C. Crane
*Attorney, Agent, or Firm*—Learman & McCulloch

[57] ABSTRACT

A tactile switch plate for a keyboard member has a planar body portion provided with a plurality of outwardly deformed carrier portions corresponding in number and spacing to the number and spacing of the keys of the keyboard. Each of the carrier portions is resiliently flexible for movement toward the plane of the body and each carrier portion carries a preferably elastomeric switching member that is adapted to bridge the conductors and establish an electrical circuit between the conductors. The plate and switching members are produced by a molding process and the elastomeric switching members are cured by heat.

20 Claims, 13 Drawing Figures

METHODS OF MANUFACTURING TACTILE SWITCH FOR KEYBOARDS AND THE LIKE

RELATED APPLICATION

This application is a continuation in part of application Ser. No. 411,345, filed October 31, 1973, now U.S. Pat. No. 3,876,586 granted Apr. 22, 1975.

The invention disclosed herein relates to methods of manufacturing an electrical switch plate for use in connection with keyboards for calculators and the like having a plurality of keys movable between inactive and operating positions so as to make and break an electrical circuit. Keyboards of the type with which the invention is concerned are in wide usage in electrical and electronic calculators, computers, machine control consoles, and the like.

Keyboards of the kind to which the invention relates conventionally employ a plurality of depressible keys any one of which may be actuated so as to establish a circuit between a source of electrical energy and electrical apparatus that is responsive to the establishing of the circuit. In those instances in which the keys are manually manipulatable, it is desirable that the operator be able to sense the movement of each key to its operative position. The previously known keyboard constructions have relied largely upon the operator's sense of touch, hearing, or both, as a means of informing the operator of the actuation of the associated switch. One of the objections associated with previously proposed tactile sensing means is that the movable part of a switch may have some chattering-type movement which can result in unreliable electrical signals being generated.

A disadvantage of those switching devices which rely upon an audible signal to indicate energization of the electrical circuit is that the use of a number of such keyboards at one time in a confined space can generate an excessive and distracting amount of noise.

Known keyboard devices have other disadvantages. For example, some of the keyboards are so constructed that reliable operation of a switch depends upon the application of a force that is substantially along the longitudinal axis of a key. It is not always possible to assure the application of such a force, however, particularly when the keyboard is manually operated. Occasionally, therefore, an operator will depress a key in such manner that the force is applied obliquely to the line of movement of the key with the result that a circuit is not completed. In addition, most of the known keyboards incorporate a large number of components for each switching mechanism as a consequence of which the cost of such switching mechanisms and the keyboard in which they are incorporated is excessive.

An object of this invention is to provide methods for the manufacture of a switching constuction for keyboards of the kind wherein the switching mechanism provides a positive, tactile sensation that may be virtually noiseless.

Another object of the invention is to provide methods for the manufacture of switching mechanisms which are operable under various conditions of force application.

A further object of the invention is to provide methods for the manufacture of such switching mechanisms and wherein there is significant reduction in the number of manipulative steps heretofore required.

Other objects and advantages of the invention will be pointed out specifically or will become apparent from the following description when it is considered in conjunction with the accompanying drawings, in which.

Figure 1:
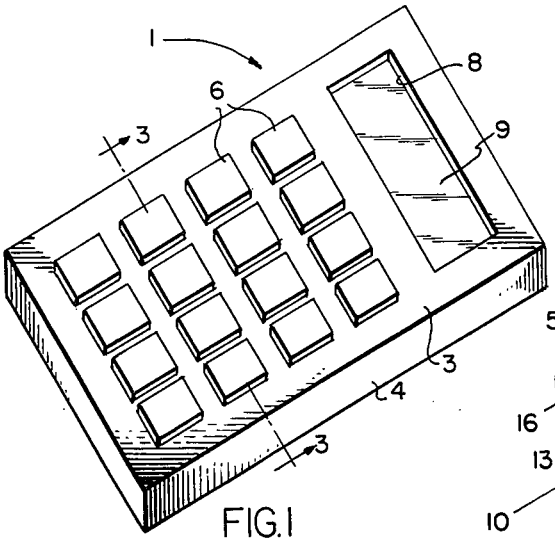
FIG. 1 is an isometric view of a calculator having a keyboard of the kind with which the invention is adapted for use.
Figure 2:
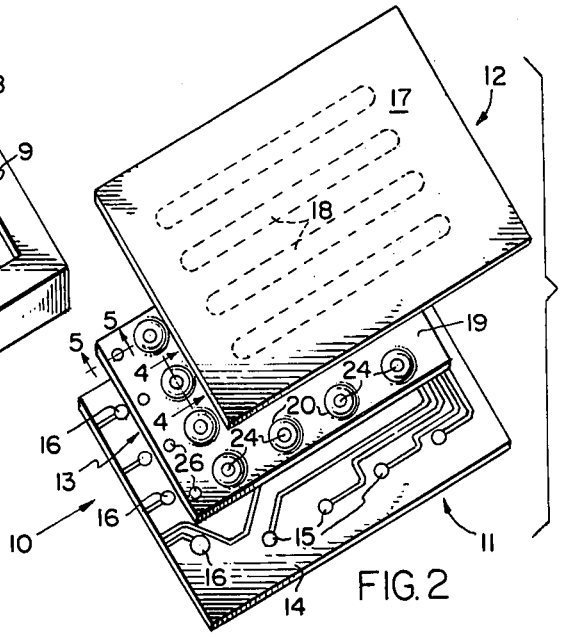
FIG. 2 is an exploded view of the parts of a switching mechanism constructed according to the invention.

Tactile switching apparatus constructed in accordance with the invention is adapted for use in conjunction with a device such as an electrically operated calculator 1 having a base 2 that is fitted to a cover 3 having a depending skirt 4 embracing the base. The cover 3 has therein a plurality of spaced apart openings 5 arranged in columns and rows and in each of which is accommodated a reciprocable key 6. Each key has flanges 7 engageable with the lower surface of the cover 3 so as to prevent withdrawal of the key from the cover. The cover also has a window opening 8 covered by a transparent pane 9 through which indicia (not shown) may be seen. The calculator 1 may have sufficient space between the cover and the base to accommodate logic circuit components and batteries (not shown) as usual. The construction of the calculator 1 as thus far described is conventional.

A switching assembly constructed in accordance with the invention is designated generally by the reference character 10 and comprises a pair of electrically conductive members 11 and 12 between which is sandwiched a switch plate 13. The conductive member 11 comprises a relatively rigid printed circuit board 14 of non-conductive material on the upper surface of which are a plurality of electrically conductive circuit elements 15 and a plurality of terminals 16. The conductive elements 15 may be coupled through the board 14 to conductive leads (not shown) on the lower surface of the board as is conventional and which, in turn, are coupled to the logic devices (not shown) for operating the indicia viewable through the window 9. The terminals 16 are adapted to be coupled to a source of energy such as one or more batteries (not shown).

The conductor 12 comprises a substrate or sheet 17 of flexible, non-conductive polyester or other suitable material on one side of which is a plurality of parallel strips 18 of electrically conductive material. The strips are of such length as to span the length of each column of keys 6 and the number and spacing of the strips 18 correspond to the number and transverse spacing of the keys 6.

The switch plate 13 comprises a flat, plate-like body 19 formed of polycarbonate, polypropylene or other suitable thermoplastic, non-conductive material or other thickness as to be stiffer than the substrate 17. The body, however, does have some inherent resilience. The body 19 is a one-piece molded member and is substantially planar except for a plurality of spaced apart carriers or dimples 20 which are deformed outwardly of the plane of the body. Each carrier, however, is completely surrounded by a flat portion of the body. The number and spacing of the carriers correspond to the number and spacing of the keys 6.

Each carrier 20 is coniform and has a web 21 terminating adjacent the apex in an annular enlargement 22 which surrounds an opening 23. The web preferably is continuous, but may be spiderlike if desired. Fitted into each opening 23 is a switching pad or member 24 which protrudes beyond both ends of the opening 23 so as to be exposed on both sides of the carrier. The switching member is composed of a non-conductive elastomer, such as silicone rubber, throughout which is dispersed a quantity of discrete, electrically conductive particles. The silicone rubber may be produced, for example, from a mixture of 4404 silicone resin (General Electric Company, Schenectady, N.Y.) and "Varox" catalyst (R. T. Vanderbilt Chemical Co., New York City), but other resins and catalysts also may be used.

Each switching member 24 may be either normally conductive or normally non-conductive, depending upon the size and quantity of particles contained therein and depending upon whether such switching member is molded under a compressive force or under atmospheric pressure. In any case, compression of a switching member 24 will cause a sufficient number of particles to move into engagement with one another as to establish an electrically conductive train of particles through the switching member.

At one end of the body 19 is a plurality of openings 25 each of which is filled with an elastomeric pad or member 26 corresponding in all respects to the switching members 24.

The particles contained in the members 24 and 26 preferably comprise spheres of a base metal, such as copper, coated with a noble metal, such as silver, which has a low resistance and an electrically conductive oxide. The conductivity of the particles thus will correspond to the conductivity of the coating or, stated differently, the electrical resistance of the members 24 and 26 will correspond to the resistance of the coating on such particles.

The size of the particles is so selected as to be capable of accommodating a predetermined current, such as that normally encountered in the electrical circuitry of the apparatus. Preferably, the size of the particles is between 3 and 8 mils in diameter, although other size particles may be utilized if desired.

To condition for operation the apparatus thus far described, the printed circuit board 14 to which is coupled the logic circuitry is secured to the base member 2 with the circuit elements 15 and the terminals 16 uppermost. The terminals 16 are connected through the board 14 to a D.C. battery carried in the calculator or to a wire assembly which may be connected to a source of A.C. energy. The switch plate 13 then is placed atop the circuit board 14 with the carriers 20 uppermost and with the pads 26 so arranged that they overlie and engage the terminals 16. The plate 13 is secured to the base by screws (not shown) or the like so that the members 26 are maintained under compression sufficient to render them conductive. The carriers 20 will overlie the circuit elements 15 and the switching members 24 will overlie, but be spaced from, predetermined portions of such circuit elements 15.

Figure 3:
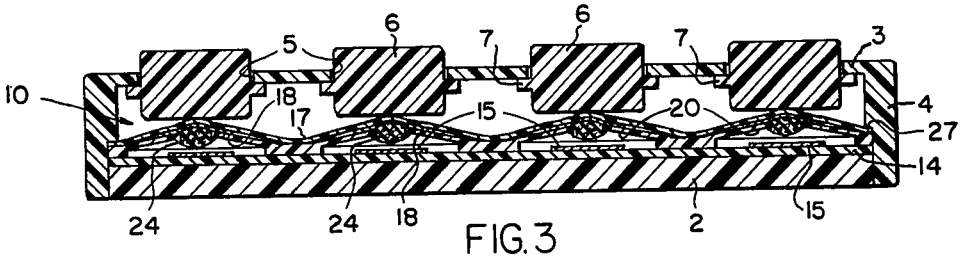
FIG. 3 is an enlarged, transverse sectional view taken on the line 3—3 of FIG. 1.

The flexible printed circuit 12 then is placed atop the plate 13 in such manner that the conductive strips 18 overlie and confront the switching members 24 and the conductive pads 26. The cover 3 then is fitted over the base 2 and is screwed or otherwise fixed to the base. As is illustrated in FIG. 3, the inner surface of the skirt 4 has a shoulder 27 which overlies the printed circuit 12 so as to cause the marginal edges of the latter to be clamped forcibly against the plate 13, thereby constantly maintaining the pads 26 and the confronting ends of the conductive strips 18 under compressive force.

When the parts are assembled in the manner disclosed, each key 6 will overlie a carrier 20 and will bear directly against the upper, non-conductive surface of the printed circuit member 12. The conical configuration of each carrier 20 will maintain its associated key 6 in its projected position in which the flange 7 engages the lower surface of the cover 3, as is shown in FIG. 3. Each key may be depressed, however, as is permitted by the flexibility of the web 21 of the associated carrier 20, whereupon the associated switching member 24 may be moved into engagement with the associated circuit element 15 so as to establish an electrical path from the battery, the associated conductive strip 18, and the circuit element 15 to effect operation of the appropriate electrical component of the logic circuit.

The presence of the conductive particles in the elastomeric switching members 24 causes the surface thereof to be slightly abrasive or gritty. As a consequence, compression of the members 24 between the members 15 and 18 causes scrubbing of such members, thereby avoiding the likelihood of non-conductivity due to oxidation of the members 15 and 18.

Figure 4:
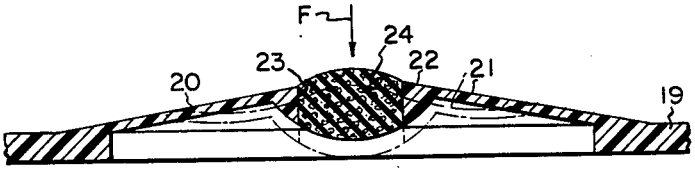
FIG. 4 is a greatly enlarged view taken on the line 4—4 of FIG. 2.
Figure 5:
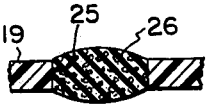
FIG. 5 is a greatly enlarged view taken on the line 5—5 of FIG. 2.

As has been stated hereinbefore, the thickness of the material constituting the body 19 is such that the latter is relatively stiff. As a consequence, it resists deformation. Although the web 21 of each carrier 20 is formed of the same material as the body 19, the web preferably has a thickness less than that of the body so as to be resiliently flexible as compared to the body itself. Thus, upon the application by a key 6 of a downward force F on a switching member 24, the switching member will move or travel toward the plane of the body 19. As the switching member 24 moves toward the plane of the body, the radius of the web 21 must shorten and, as a consequence, the web 21 must buckle or distort. The construction of each carrier 20 is such that, as the lower surface of its switching member 24 approaches the level of its associated circuit element 15, the web 21 is distorted so as to assume an undulating configuration, as indicated in dotted lines in FIG. 4. Such distoration occurs very rapidly and produces a tactile sensation which the operator may sense through his finger. Since the web 21 is composed of a plastic material, rather than metal, the noise associated with such distortion is much less than that which would be encountered if the web were formed of metal.

Following the distortion of the web 21, the force required to move the switching member 24 into engagement with the associated circuit elment 15 is much less than that required to effect distortion of the web. Therefore, the switching member may be moved into engagement with the circuit element quite easily, thereby minimizing the likelihood of chattering movement of the switching member.

The force required to move a switching member into engagement with its associated circuit element 15 is stored in the distorted, resilient web 21. Consequently, when the force F is removed, the resiliency of the web 21 enables its automatic return to its original position. Return of the web to its original position breaks the circuit between the conductive elements 15 and 18 and restores the depressed key to its projected position.

Figure 6:
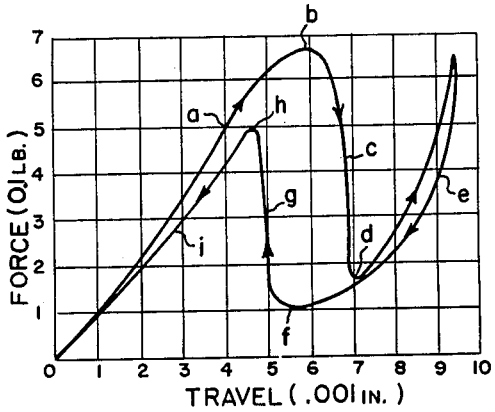
FIG. 6 is a force versus travel graph of a typical switching operation.

FIG. 6 illustrates in graphic form the foregoing force/travel characteristics of a typical carrier 20 when the associated switching member 24 moves through one cycle of operation. In the graph segment *a* indicates that a force of about 0.66 pound must be applied to the carrier 20 via a key 6 to initiate distortion of the web 21 and, when the web commences its distortion, the switching member 24 will have moved toward the plane of the body 19 a distance of about 0.006 inch, as is indicated by the point *b*. As the web 21 distorts, the force required to be exerted on the switching member to effect its engagement with the associated switch element 15 is reduced to about 0.16 pound, as is indicated by the segment *c*, and the additional movement of the switching member toward the circuit element 15 amounts to about 0.001 inch, as is indicated by the point *d*. Thereafter, the operator may exert whatever force he desires (within reasonable limits) to maintain the switching member 24 in conductive engagement with the circuit element 15. It will be understood that the movement of switching member 24 into engagement with the circuit element 15 will be effected by a smooth application of a downward force on a key 6. However, the graph illustrates the variations in force accompanying distortion of the web 21 which produces the desired tactile sensation.

When the operator removes his finger from the depressed key, the resilient web 21 immediately commences its recovery to its initial conical configuration due to the energy stored in the disorted web, thereby resulting in a lessening of the force to which the web 21 is subjected, as is indicated by the segment *e*. At the point at which the distorted web commences its restoration to its conical form, the web is subjected to an increasing force, as is indicated by the segment *g*, until such time as the web is fully restored, as indicated by the point *h*, whereupon the force to which the web is subjected diminishes rapidly as indicated by the segment *i*.

An important advantage of the invention is that, for any given switch plate 13, each carrier requires the application of the identical force to effect its switching function. As a consequence, the operating characteristics of each key of the entire keyboard will be the same. Such uniformity of key-to-key operation minimizes errors in the operation of the calculator or the like.

Among the advantages of the invention are the ease and simplicity by means of which the operating characteristics of a given switch plate 13 may be varied. Since each body 19 is a one-piece, molded member, the mold for a particular body may be so constructed as to produce webs of any desired thickness. The thickness of a web 21 determines, to a large extent, the force which must be applied thereto to effect its distortion and, in general, the thicker the web the greater must be the applied force. In addition, the thickness of a web, together with the material from which it is made, has a direct relationship upon the tactile sensation and the noise of operation. That is, the thicker the web, the greater the tactile sensation and the greater the noise. As a consequence, the tactile sensation and the noise of operation of a switch constructed in accordance with the invention may be varied within wide limits.

A switching assembly constructed according to the invention effectively overcomes the aforementioned problem associated with the application of an oblique force on an operating key. If the applied force has a component sufficient to depress the key, the key will effect deformation of the associated carrier 20 inasmuch as the transmission of force from the key to the carrier occurs at substantially a point contact due to the conical configuration of the carrier.

Figure 7:
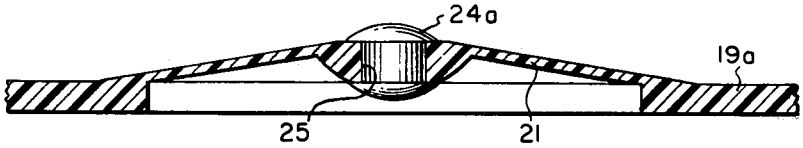
FIG. 7 is a fragmentary, enlarged sectional view of a modification.

Although it is preferred that the members 24 and 26 be elastomeric, they could be formed of other materials. For example, FIG. 7 discloses a switch plate **19*a* identical in all respects to the switch plate body 19 except that the switching member 24*a* is a conductive, metallic rivet. A similar rivet could be fitted into each of the openings 25**.

Figure 8:
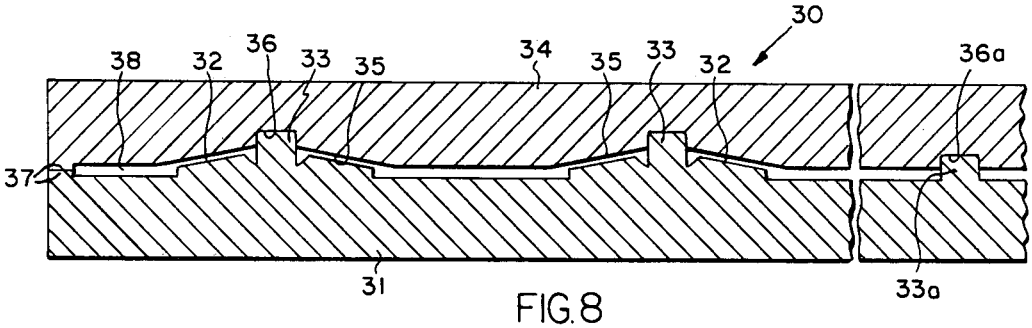
FIG. 8 is a fragmentary, enlarged sectional view of a typical mold in which a switchplate according to the invention may be formed.

The body 19 of a switch plate 13 according to the invention preferably is molded in a mold 30 which, as is illustrated in FIG. 8, has a base 31 on the upper surface of which is a plurality of upstanding conical projections 32 corresponding to the configuration of the carriers 20 except that at the apex of each projection 32 is a cylindrical pin 33. Adapted to mate with the mold base 31 is a cover 34 which has in its lower surface a plurality of recesses 35 corresponding in number and spacing to the projections 32. At the base of each recess is a socket 36 that is adapted to receive the pin 33 of the associated projection 32. The base also carries adjacent one end thereof a plurality of upstanding pins **33*a* and the cover has a corresponding number of sockets 36*a***.

Figure 9:
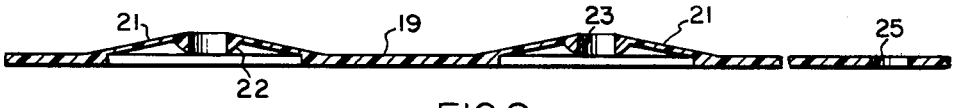
FIG. 9 is a fragmentary, sectional view of a switchplate produced in the mold of FIG. 8.

At the marginal edges of the mold halves 31 and 34 are ribs 37 which space the confronting surfaces of the mold members so as to define therebetween a cavity 38 which corresponds to the shape and thickness of the body 19 that is to be molded. Suitable openings (not shown) are provided in communication with the cavity 38 for the admission of a liquid thermoplastic material so as to enable the body 19 shown in FIG. 9 to be molded.

The molded body 19 produced by the mold 30 has the webs 21, the enlargements 22, and the openings 23 and 25, but none of the openings at this time contains a switching member. If the metal switching member **24*a* is to be utilized, the molded body 19 is presented to a riveting machine of conventional construction wherein a rivet 24*a* is fitted into each opening 23 and 25**.

Figure 10:
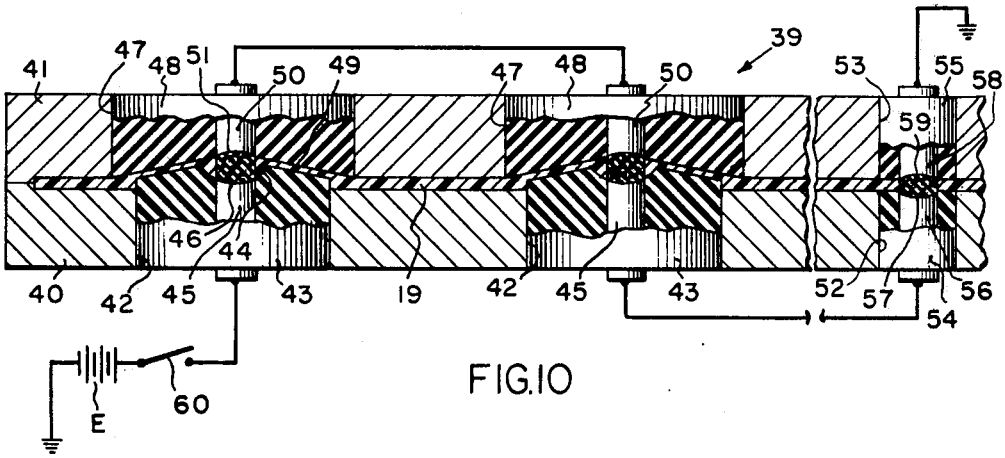
FIG. 10 is a fragmentary, sectional view illustrating the manner of curing switching members according to one embodiment of the invention.

In practicing the method illustrated in FIG. 10, use is made of a fixture 39 having a base 40 and a cover 41. The base 40 of the fixture has a plurality of openings 42 therein corresponding to the number and spacing of carriers 20 and in each opening 42 is secured an electrically non-conductive post 43 having an upper surface 44 that corresponds to the contour of the lower surface of the carrier 20. Each post 43 supports an electrode 45 having a concave upper surface 46 in register with the opening 23 of the carrier 20.

The fixture cover 41 has a number of openings 47 corresponding to the number of openings 42 and in each of which is secured a non-conductive post 48 having a lower surface 49 which corresponds to the contour of the upper surface of the carrier 20. Each post 48 carries an electrode 50 having a concave lower surface 51 which registers with the opening 23.

The fixture base 40 has openings 52 corresponding to the number and spacing of the conductive members 26 and the cover 41 has similar openings 53. In each of the openings 52 is a non-conductive post 54 and a similar post 55 is fitted into each of the openings 53. Each post 54 has an electrode 56 having a concave upper surface 57 and each post 55 has a similar electrode 58 having a concave lower surface 59.

Following the molding of a body 19 the latter is placed atop the fixture base 40 as that the carriers 20 overlie the posts 43 with the openings 23 and 25 in register with the electrodes 45 and 56, respectively. A putty-like module composed of an uncured mixture of silicone resin, catalyst, and electrically conductive particles then is introduced into each of the openings 23 and 25 and in such quantity that the module occupies not only the corresponding openings, but also engages the concave surfaces 46 and 57 of the respective electrodes 45 and 56 and projects above the upper surface of the body 19. Thereafter, the upper fixture half 41 may be lowered so as to overlie the body 19 with the concave surfaces of the electrodes 50 and 58 engaging the upper surfaces of the uncured modules. The halves 40 and 41 of the fixture 39 then are clamped against the body 19 so that the modules are subjected to sufficient compression to cause the particles in the modules to establish an electrically conductive path through each module.

In the method disclosed in FIG. 10, the modules are cured to form the switching members 24 and 26 by the heat of an electric current that is passed in series through each module. This procedure may be effected by connecting one end of a source of direct current electrical energy E through a switch 60 to each of the electrodes 45, 50, 56, and 58 in a series circuit so that, upon closing of the switch 60, current will pass through each of the electrodes in turn.

The current selected for the curing of the modules will depend upon a number of factors, such as the curing time and temperature of a specific resin and catalyst, the number and size of modules to be cured, and the size and conductivity of the conductive particles contained in the modules. Modules containing between about 80–93 percent (by weight) of 3–8 mil diameter silver coated copper particles and having a diameter of about 0.125 inch and a thickness of about 0.06 inch successfully have been cured by passing therethrough a direct current of between 25–28 amperes for about 12 seconds. Following curing of the modules to form the switching members 24 and 26, the fixture 39 may be opened and the completed switch plate 13 removed.

It is not essential that the modules constituting the switching members 24 and 26 be cured by the passage of current therethrough. It is possible to effect curing of the modules by heating the entire fixture to the curing temperature of the resin and catalyst and maintaining the temperature for the prescribed curing time. The electrical current curing process, however, is considerably faster and requires the use of considerably less heat energy.

Figure 11:
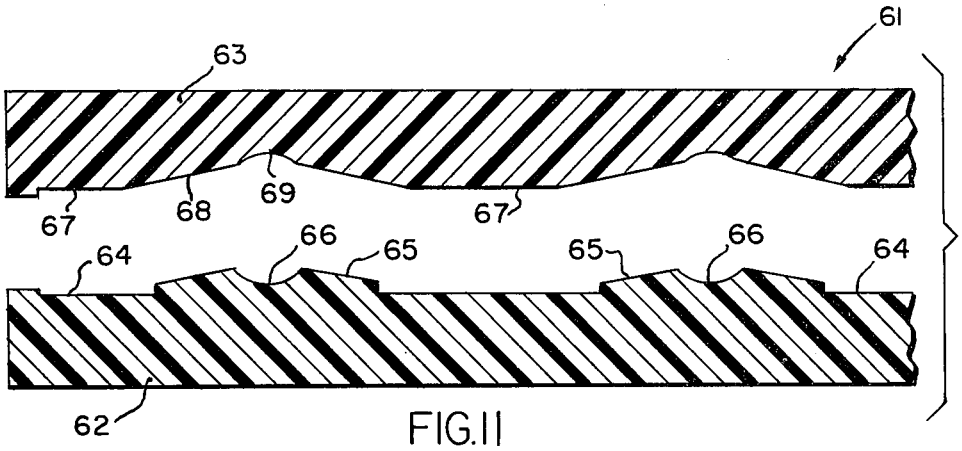
FIG. 11 is a fragmentary, exploded, sectional view of a modified mold for curing switching members carried by a switchplate.
Figure 12:
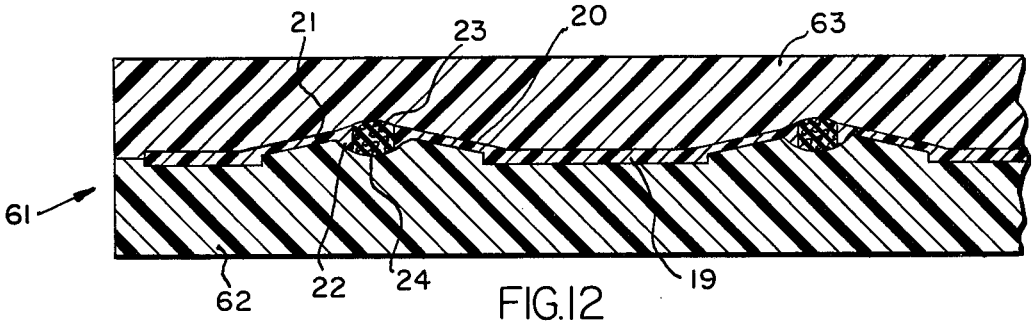
FIG. 12 is a view similar to FIG. 11, but illustrating a switchplate in the mold of FIG. 11.
Figure 13:
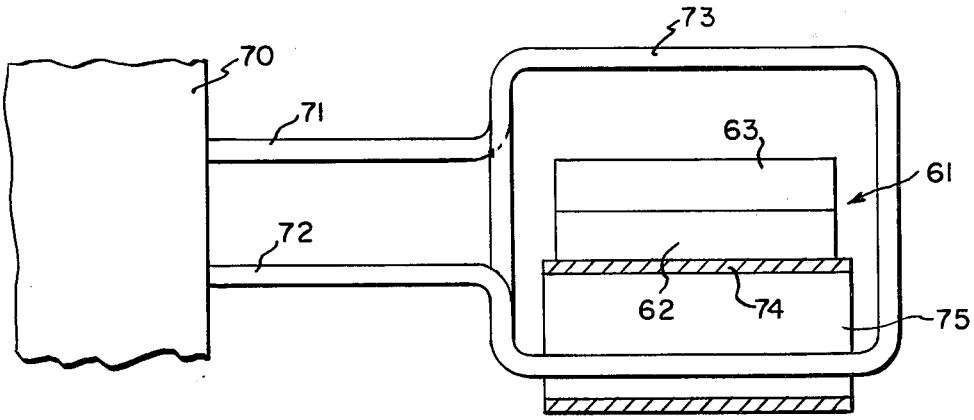
FIG. 13 is a fragmentary, partly sectional view illustrating the manner in which switching members are cured in accordance with a second embodiment of the invention.

Another method of curing the switching members is illustrated in FIGS. 11 – 13 and comprises an induction heating process. In this process use is made of a mold or fixture 61 having a base 62 and a cover 63, both the base and the cover being formed of a non-conductive material such as a suitable phenolic or ceramic. The upper face of the base 62 has a flat surface 64 interrupted by a plurality of conical projections 65 at the apex of each of which is a concave recess 66. The number and spacing of the projections 65 correspond to the number and spacing of the carriers 20 of the body 19. The lower face of the cover 63 has a flat surface 67 interrupted by a plurality of conical recesses 63 at the apex of each of which is a concave cavity 69. The number and spacing of the recesses 68 correspond to the number and spacing of the projections 65 and the location of each cavity 69 is such that it may overlie the companion recess 66. The confronting surfaces of the fixture halves 62 and 63 are such that a molded body 19 may be interposed therebetween and be snugly engaged on its opposite sides by the respective fixture halves.

In the induction heating process, a molded body 19 is placed atop the fixture base 62 so that the carriers 20 overlie the projections 65. A putty-like module like that earlier described and composed of an uncured mixture of silicone resin, catalyst, and electrically conductive particles is introduced into each of the openings 23 and in such quantity that such module occupies not only the corresponding openings, but also engages the surface of the recess 66 and projects above the upper surface of the body 19. Thereafter, the upper fixture half 63 may be lowered so as to overlie the body 19 with the surfaces of the cavities 69 engaging the upper surfaces of the uncured modules. The fixture halves 62 and 63 then are clamped together in any suitable manner so that the modules are subjected to sufficient compression to cause the particles in each module to establish therethrough an electrically conductive path.

Induction heating and curing of the modules may be effected by a radio frequency generator of the kind manufactured by Lepel High Frequency Laboratory, Inc., New York, N.Y., positioned within a housing 70 and connected by terminals 71 and 72 to a work coil 73 through which extends the upper run 74 of a driven, endless conveyor 75.

In the induction heating process the high frequency generator generates an alternating current of radio frequency in the work coil 73. As the fixture 61 containing the body 19 and the uncured switching modules passes through the coil by means of the conveyor 75, a current will be induced in the metal particles contained in the modules, thereby producing heat which will be transferred to the silicone resin and catalyst and effect curing of the resin. The particular frequency selected for generation by the generator and the length of time that each module is subjected to induction heating will depend upon several factors, such as the size and resistance of the metal particles contained in the resin and the temperature and time required to effect curing of the resin. For a given formulation of the switching module, these factors can be determined empirically so that each module will be subjected at a temperature and for a time sufficient to effect the cure. In general, the induction curing process is much faster than those discussed earlier because the curing temperature can be reached in a much shorter period of time.

Following curing of the modules to form the switching members, the fixture 61 may be opened and the completed switch plate 13 removed.

In many instances the curing temperature of elastomeric modules is higher than the liquification temperature of the material from which the body 19 is composed. Inasmuch as the body 19 is clamped within a fixture having confronting surfaces corresponding to the surfaces of the body, however, any liquification of the body 19 is of no consequence inasmuch as the liquified material will solidify once the application of heat terminates. Liquification of the material of the body 19 adjacent the openings 23 and 25 may be advantageous in the establishment of a strong, adhesive bond between the switching members and the material of the body.

Although the methods herein described are directed primarily to the production of a tactile switching member, it should be understood that such methods are applicable to the provision of an electrically conductive path through any non-conductive member.

The disclosed methods are representative of presently preferred forms thereof, but are intended to be illustrative rather than definitive of the invention. The invention is defined in the claims.

We claim:

1. A method of making an electrical switching device comprising forming an electrically non-conductive material into a substantially planar, relatively rigid body surrounding a stiff but relatively flexible portion protruding to one side of the plane of said body and having a thickness less than that of said body; forming an opening in said flexible portion; filling said opening with a module of uncured, heat curable, electrically non-conductive resin having a plurality of electrically conductive particles dispersed therein; and heating said module to a temperature and for a period of time sufficient to cure said resin and form an electrically conductive member supported by said flexible portion.

2. The method according to claim 1 wherein said module is compacted while heated to an extent to render it electrically conductive.

3. The method according to claim 1 wherein the heating of said module is effected by passing an electric current therethrough.

4. The method according to claim 1 wherein the heating of said module is effected by inducing an electric current in said particles.

5. The method according to claim 4 wherein the induced current is of radio frequency.

6. The method according to claim 1 wherein the material forming said flexible portion has a liquification temperature and wherein said module is heated to a temperature at least as great as the liquification temperature of the material forming said flexible portion.

7. The method according to claim 1 wherein said resin is elastomeric.

8. The method according to claim 1 wherein said conductive member is resilient.

9. The method according to claim 1 wherein said module protrudes beyond both ends of said opening.

10. The method according to claim 1 wherein said flexible portion is substantially coniform and wherein said opening is formed at the apex of said coniform portion.

11. A method of making an electrical switching device comprising forming electrically non-conductive material into a non-conductive switch plate having a substantially planar body provided with a plurality of spaced apart, flexible protrusions deformed outwardly from the plane of said body and having a thickness less than that of said body; forming an opening in each of said protrusions; filling each of said openings with a module comprising an uncured, heat curable, non-conductive resin having a plurality of electrically conductive particles dispersed therein; and heating each of said modules to a temperature and for a period of time sufficient to cure said resin and form an electrically conductive member supported by its associated protrusion.

12. The method according to claim 11 wherein each of said modules is compacted while being heated to an extent to render it electrically conductive.

13. The method according to claim 11 wherein the heating of each of said modules is effected by passing an electric current therethrough.

14. The method according to claim 11 wherein the heating of each of said modules is effected by inducing an electric current in said particles.

15. The method according to claim 14 wherein the induced current is of radio frequency.

16. The method according to claim 11 wherein the material forming said protrusions has a liquification temperature and wherein each of said modules is heated to a temperature at least as great as the liquification temperature of said material.

17. A method of applying an electrically conductive member to a non-conductive support comprising forming an opening in said support; filling said opening with a module comprising an uncured, heat curable resin having a plurality of electrically conductive particles dispersed therein, said module projecting beyond at least one end of said opening; heating said resin at least to its curing temperature by inducing an electric current in said particles; and maintaining said current for a sufficient period of time to cure said resin.

18. The method according to claim 17 including subjecting said module to compressive force sufficient to render said module conductive as said resin is heated.

19. The method according to claim 17 wherein said support has a liquification temperature and including heating said resin to a temperature at least as great as said liquification temperature.

20. The method according to claim 17 wherein the induced current is of radio frequency.

* * * * *

UNITED STATES PATENT AND TRADEMARK OFFICE

CERTIFICATE OF CORRECTION

PATENT NO. : 4,067,102

DATED : January 10, 1978

INVENTOR(S) : DuRocher et al

It is certified that error appears in the above-identified patent and that said Letters Patent are hereby corrected as shown below:

Change the patent number referred to under the heading "Related U.S. Application Data" from "3,876,586 to --3,879,586--

Column 3, line 11, after "material" insert --and is of such--

Column 3, line 11, delete "or"

Column 3, line 12, delete "other"

Column 8, line 15, change "63" to --68--

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*